US006525632B2

(12) United States Patent
Schneider et al.

(10) Patent No.: US 6,525,632 B2
(45) Date of Patent: Feb. 25, 2003

(54) MAGNETIC RELEASE, IN PARTICULAR FOR A CIRCUIT BREAKER, AND A CIRCUIT BREAKER HAVING SUCH A MAGNETIC RELEASE

(75) Inventors: Alexander Schneider, Leimen (DE); Richard Kommert, Heidelberg (DE)

(73) Assignee: ABB Patent GmbH, Ladenburg (DE)

( * ) Notice: Subject to any disclaimer, the term of this patent is extended or adjusted under 35 U.S.C. 154(b) by 0 days.

(21) Appl. No.: 09/946,942

(22) Filed: Sep. 4, 2001

(65) Prior Publication Data

US 2002/0050889 A1 May 2, 2002

Related U.S. Application Data

(63) Continuation of application No. PCT/EP00/01699, filed on Feb. 29, 2000.

(30) Foreign Application Priority Data

Mar. 3, 1999 (DE) ..... 199 09 111

(51) Int. Cl.[7] ..... H01H 75/12

(52) U.S. Cl. ..... 335/35; 336/225; 336/232

(58) Field of Search ..... 336/183, 222, 336/225, 226, 228, 232, 179; 335/35–42, 167–176

(56) References Cited

U.S. PATENT DOCUMENTS 5,126,715 A * 6/1992 Yerman et al. ..... 336/183

5,291,173 A * 3/1994 Yerman et al. ..... 336/183

FOREIGN PATENT DOCUMENTS

| | | |
|---|---|---|
| DE | 1 764 087 | 4/1971 |
| DE | 31 43 210 A1 | 5/1983 |
| DE | 148 789 | 8/2001 |
| EP | 0 439 389 A1 | 7/1991 |
| FR | 2 586 135 A1 | 2/1987 |
| FR | 2 721 431 A1 | 12/1995 |
| JP | 04 196 507 A | 7/1992 |

* cited by examiner

*Primary Examiner*—Lincoln Donovan
*Assistant Examiner*—Tuyen T. Nguyen
(74) *Attorney, Agent, or Firm*—Laurence A. Greenberg; Werner H. Stemer; Gregory L. Mayback

(57) ABSTRACT

A magnetic release is described for an electrical switching device, such as a circuit breaker, which has a coil, a core located inside the coil, and an armature in the form of a plunger-type armature which can move inside the coil or in the form of a hinged armature. The coil is stamped and bent from sheet metal composed of an electrically highly conductive material. It has first webs that are located at a distance from one another in a first plane and second webs that are likewise located at the same distance from one another in a second plane. The webs each run parallel to one another and are offset with respect to one another in such a manner that the webs are disposed with connecting webs in a helical shape around a center axis, and on the inside form a through-opening for accommodating at least one core.

10 Claims, 4 Drawing Sheets

MAGNETIC RELEASE, IN PARTICULAR FOR A CIRCUIT BREAKER, AND A CIRCUIT BREAKER HAVING SUCH A MAGNETIC RELEASE

CROSS-REFERENCE TO RELATED APPLICATION

This application is a continuation of copending International Application No. PCT/EP00/01699, filed Feb. 29, 2000, which designated the United States.

BACKGROUND OF THE INVENTION

FIELD OF THE INVENTION

The invention relates to a magnetic release for a switching device in particular for a circuit breaker. The magnetic release has a coil, a core located inside the coil and an armature that may be in the form of a plunger-type armature moving inside the coil or in the form of a hinged armature.

A magnetic release, in particular for a circuit breaker, contains a coil which is produced from wire wound in a helical shape, a magnet core which is firmly connected to a yoke surrounding the coil on the outside and which engages in the interior of the coil, and a magnet armature which is either in the form of a hinged armature or a plunger-type armature, with the latter likewise being located inside the coil. In one known configuration, the core and the armature are located inside a cylindrical tube, with the armature being held at a distance from the core by a compression spring, so that the armature is attracted towards the core, against the force of the spring, when an overcurrent or short-circuit current is present. At one end, the coil is connected to the yoke, which at that point has a holder for a thermal bimetallic strip and at the other end is fitted with a stationary contact piece, which merges into an arc guide rail which bounds an arc splitter stack on the release side and feeds the base of the arc which is produced on the stationary contact piece to the arc splitter stack.

In a configuration such as this, an insulated wire composed of copper must be stripped and wound into a helical shape at the ends in order to produce the coil, which involves the use of a large amount of labor time. Furthermore, the coil must also have an associated yoke, to which the coil tube is fitted, and around which the insulated wire is wound and is guided in the armature and core. Production of this configuration is costly.

SUMMARY OF THE INVENTION

It is accordingly an object of the invention to provide a magnetic release, in particular for a circuit breaker, and a circuit breaker having such a magnetic release that overcomes the above-mentioned disadvantages of the prior art devices of this general type, whose manufacture is simplified.

With the foregoing and other objects in view there is provided, in accordance with the invention, a magnetic release for an electrical switching device. The magnetic release contains a coil being stamped and bent from sheet metal composed of a material being electrically highly conductive and magnetically highly permeable. The coil has first webs disposed at a given distance from one another in a first plane and second webs disposed at the given distance from one another in a second plane and in each case run parallel to one another and offset with respect to one another. The coil has connecting webs in each case disposed between one end of one of the first webs and an adjacent end of one of the second webs and in each case one end of one of the second webs and an adjacent end of one of the first webs. The first webs, the second webs and the connecting webs are disposed in such a manner that the first webs, the second webs and the connecting webs are in a helical shape around a center axis. The first webs, the second webs and the connecting webs define an inside region in a form of a through-opening, the coil additionally having a stationary contact piece of a contact point for a circuit breaker. A holder for a thermal release is integrally formed on the coil and a core is accommodated in the through opening of the coil. An armature of a plunger-type armature moving inside the coil or a hinged armature is provided.

According to a further refinement of the invention, an arc guide rail for an arc splitter stack is then integrally formed on the stationary contact piece. An arc splitter stack, for quenching, is integrally formed on the arc guide rail, inside the electrical switching device.

In addition, a core can also be integrally formed on the coil. More specifically, an L-shaped lug can be integrally formed at one end on the coil, the L-shaped lug having a free limb projecting into a coil area on its center axis, and forms the core.

The coil, the stationary contact piece, the arc guide rail and the holder for the thermal release, possibly together with the core, thus form a unit. There is no longer any need for wire windings. Since the coil is formed from sheet iron, there is likewise no longer any need for an autonomous yoke.

A coil as such, without a stationary contact piece, arc guide rail and holder for the thermal release, has been disclosed per se in German Patent DE 6 66 920. The coil is essentially used as a field coil for synchronized machines or direct-current machines, to be precise in order to replace the flat conductors, wound on edge.

Such a refinement of the coil can be produced easily by stamping from a metal sheet and by folding and bending, so that there is no longer any need for special winding apparatuses with a winding mandrill or the like.

According to a further embodiment, the first and second webs are U-shaped, with the U-shape of the first and second webs each being open towards the opposite plane.

The connecting webs can then advantageously be connected alternately at one end of each web to one limb of the U-shape and at the other end to the other limb of the U-shape.

This results in a concertina-like coil which is stamped and bent in a helical shape from sheet metal composed of a material which is electrically highly conductive and magnetically highly permeable, in which case there is no need to coat the sheet metal with an insulating material, since the individual turns do not touch one another.

In accordance with an added feature of the invention, the connecting webs each assume an angle to one another, and one of the connecting webs runs parallel to another, over others of the connecting webs. The connecting webs can also run parallel to one another at right angles to the center axis.

A circuit breaker can be formed of the magnetic release as described above. The circuit breaker has a housing with inner surfaces, mutually opposite ones of the inner surfaces have strips that engage between coil turns in order to guide the coil.

In accordance with a further feature of the invention, the strips are configured such that they are used to guide the core and/or the armature.

In accordance with a concomitant feature of the invention, an arc guide rail is integrally formed on the coil. The core, the stationary contact piece and the arc guide rail are disposed at one end of the coil, and the holder for the thermal release is disposed at another end of the coil.

Other features which are considered as characteristic for the invention are set forth in the appended claims.

Although the invention is illustrated and described herein as embodied in a magnetic release, in particular for a circuit breaker, and a circuit breaker having such a magnetic release, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
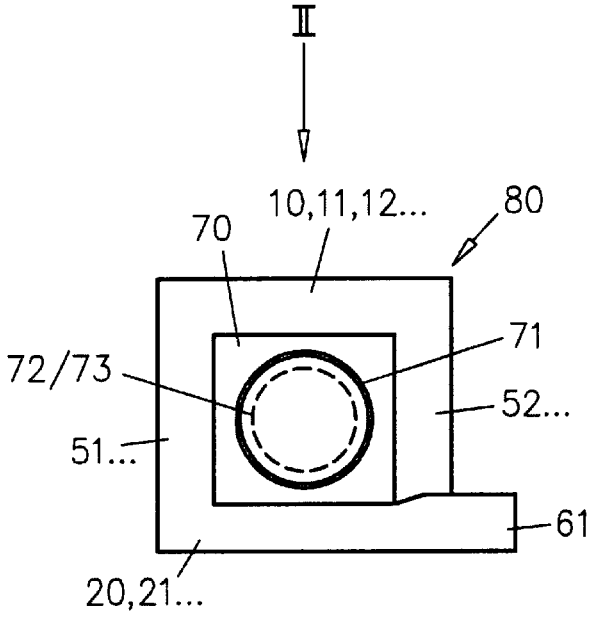
FIG. 1 is a diagrammatic plan view of a coil according to the invention, without a stationary contact piece, arc guide rail or holder for a thermal bimetallic strip.

In all the figures of the drawing, sub-features and integral parts that correspond to one another bear the same reference symbol in each case. Referring now to the figures of the drawing in detail and first, particularly, to FIG. 5 thereof, there is shown side view of a coil 80. A U-shaped extension 82, whose open side 83 points towards the coil 80, is integrally formed on a coil web 81 located at an upper end of the coil 80 in FIG. 5. A limb 84 of the U-shaped extension 82 which is immediately adjacent to the coil web 81 is fitted with a stationary contact piece, which is not illustrated in any more detail, for a circuit breaker, which stationary contact piece interacts with a moving contact piece 120 as illustrated, for example, in the case of the S2 switching device from ABB Stotz-Kontakt GmbH. The limb 84 runs parallel to the coil web 81, and a further limb 85 runs at an acute angle to the limb 84 and is adjacent to an arc guide rail 86 which runs parallel to a center axis M—M of the coil 80. The arc guide rail 86 bounds an arc splitter stack 130 on the side adjacent to the coil 80.

Figure 3:
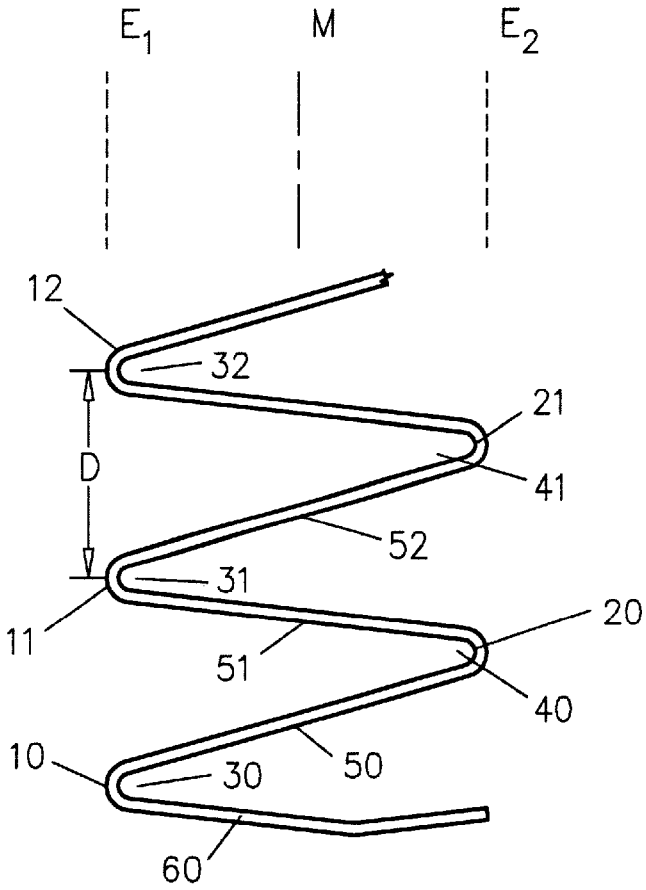
FIG. 3 is an illustration of the coil in the direction of the arrow III shown in FIG. 2.
Figure 5:
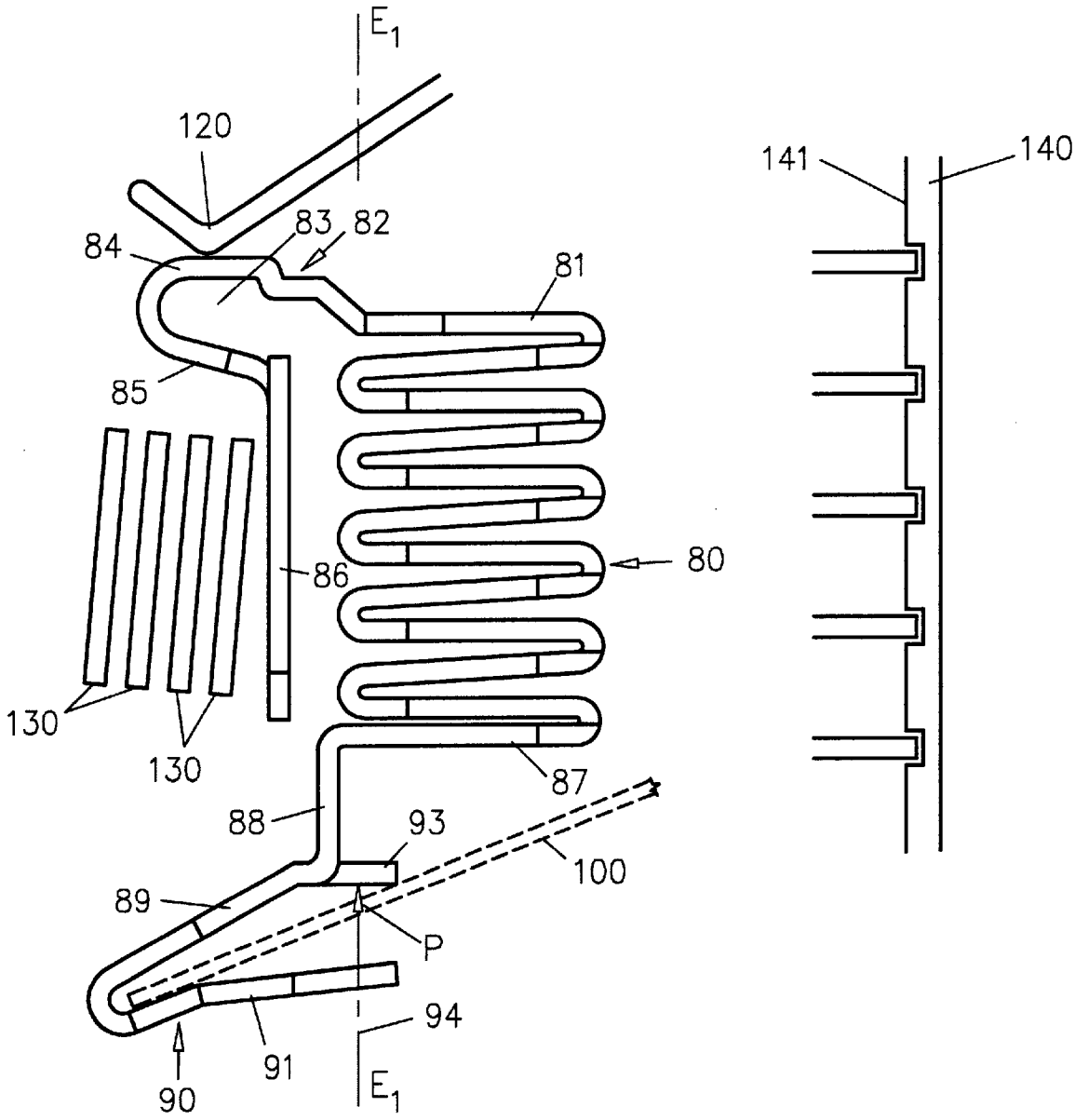
FIG. 5 is a side-elevational view of the coil with a stationary contact piece, the arc guide rail and the holder for a thermal bimetallic strip.

A coil web 87 of the coil 80, which is located at the opposite end, at the lower end of the coil 80 in FIG. 5, has a bend 88 which runs at right angles thereto, and runs parallel to the center axis M—M, to be precise approximately in a plane $E_1$, see also FIG. 3. A limb 89 of a holder 90 for a thermal bimetallic strip 100 is integrally formed on it. The thermal bimetallic strip 100 is fixed on the other, free limb 91 of the holder 90. A lug 93 that runs parallel to the coil web 87 and interacts with the limb 91 is integrally formed at the junction point of the limb 88 and of the limb 89. A threaded screw 94 is screwed through the limb 91 and its other end, as shown by the arrow P, rests against that surface of the lug 93 which is opposite the limb 91, so that the distance between the lug 93 and the free end of the limb 91 can be varied to allow the thermal bimetallic strip 100 to be adjusted. Such a holder is also provided, per se, in the S2 circuit breaker mentioned above.

As can be seen from FIG. 5, the coil 80, the extension 82 with the stationary contact piece on the limb 84, the arc guide rail 86 and the holder 90 for the thermal bimetallic strip 100 form a unit. The coil 80 contains an armature, which is not illustrated, and a core, which is firmly connected to the coil 80 and is likewise not illustrated, in which case the core may, for example, be integrally formed on or attached to the coil web 81 (see FIGS. 6 and 7). If necessary, an armature guide tube (not illustrated in any more detail) can be provided for guiding the armature.

Since the coil is composed of magnetically permeable material, there is no longer any need for an autonomous yoke.

Figure 2:
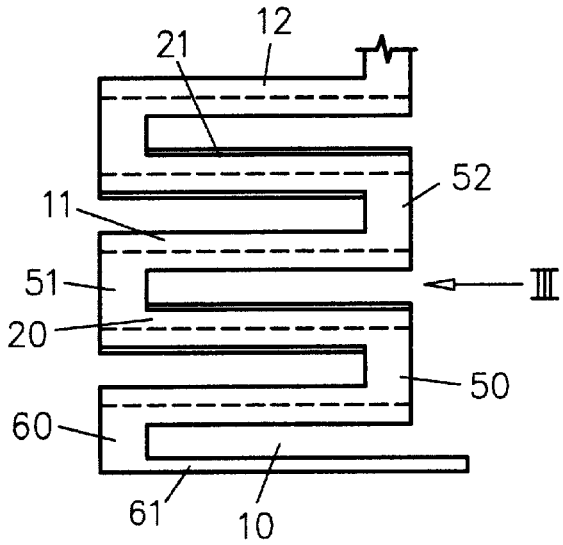
FIG. 2 is an illustration of the coil in the direction of the arrow II shown in FIG. 1.

Let us now refer to FIGS. 2 and 3, in order to show how the coil 80 for the release can be produced.

The view in FIG. 3 shows webs 10, 11 and 12 . . . , which lie approximately in a plane, and with a distance D between them in each case being the same. A first plane is represented by the line $E_1$. Parallel to the first plane, there is a second plane $E_2$ in which second webs 20, 21 . . . are located, the distance between which is likewise equal to the distance D. The first and second webs 10, 11, 12 . . . ; 20, 21 . . . run parallel to one another, are in each case disposed offset with respect to one another, and each have a U-shape, whose open sides 30, 31, 32 and 40, 41 . . . , respectively, are each open towards the opposite plane. The web 10 is connected by an obliquely running connecting web 50 to the web 20; at the opposite end, the web 20 is connected to the web 11 via a connecting web 51, the web 11 is connected to the web 21 via a connecting web 52 at the opposite end, etc, so that this results in a coil which is disposed in a zig-zag shape, is wound around the center axis M—M, and is composed of the connecting webs, and the first and second webs. A connecting line 61 (FIG. 2) in the form of a wall is connected via a connecting web 60 to the first web 10, and, for example, a fixing point for a thermal bimetallic strip can be fitted or integrally formed on the opposite last web.

Figure 4:
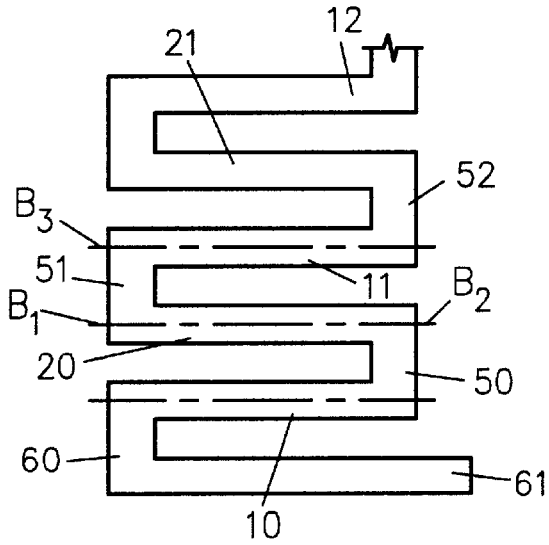
FIG. 4 is an illustration of a development of the coil, as shown in FIGS. 1 to 3, as a stamped sheet-metal part.

FIG. 4 shows the bend in the sheet-metal shape after stamping but before folding, with the webs 10, 11 and 12 . . . and the webs 20, 21 . . . together with the connecting webs 60, 50, 51, 52 . . . all lying in one plane.

In order to form the coil, the web 10 is bent along the bending line B, such that the U-shape points towards the plane of the drawing; the web 20 is bent along the bending line $B_2$, so that the U-shape is open towards the viewer; the web 11 is bent once again so that the tip faces the viewer and the open U-shape faces the plane of the drawing, etc, so that only one bend along the bending line $B_1$, $B_2$, $B_3$ . . . is required to produce the coil.

It can be seen from FIG. 3 that the connecting webs 50, 51, 52, 60 each form an angle with one another. Depending on the number of turns which are required for an appropriate application, the connecting webs 50, 51, 52 . . . and the web 60 can run parallel to one another, in which case the U-shape can be configured to be polygonal or rounded with two parallel limbs.

The configuration of the individual connecting webs and connections is illustrated in FIG. 1, which shows a view in the direction of the arrow I in FIG. 2. The special configuration, stamping and winding result in a coil being formed which surrounds an internal area 70 whose center axis corresponds to the center axis M, and a coil tube 71 can be inserted into the internal area or recess 70 in which, represented by dashed lines, a core 72 and an armature 73 are located. The coil tube 71 corresponds to the normal coil tubes as are present and are known in commercially available magnetic releases.

The material may be steel strip that is copper-plated on both sides in order to improve the electrical conductivity; such steel strips are commercially available.

The yoke that a magnetic release normally contains can be integrally formed on the coil 80, by appropriate shaping of the supply line 61, for example. At the same time, the core 72 can also be attached to the connecting conductor 61, which could at the same time also be fitted with a stationary contact.

When the coil 80 is inserted into a housing, then projections are expediently provided on the inner surface of the housing and engage in the space in-between the individual webs 20, 21 and 10, 11, in order to guide the coil 80 and in order to prevent the individual connecting webs 60, 50, 51, 52 . . . being drawn towards one another when a short-circuit occurs, although this is not shown.

The armature 73 or the core 72 shown with a circular shape in FIG. 1 may also be configured with a rectangular cross section; it can be guided in a coil sleeve, as illustrated, or in housing projections, which are provided on the guide strips or guide projections on the housing, in order to guide and hold the coil.

The invention is illustrated using a plunger-type armature magnetic release; it is, of course, also possible to configure the core such that it passes completely through the coil, and the armature may then also be in the form of a hinged armature. Since the coil is made of iron, it acts as a yoke. Copper-plated iron can be used for high current densities.

This results in a yoke, coil, stationary contact piece and thermal bimetallic strip fixing together with an arc guide rail of integral composition, which can be produced as stamped and bent material from sheet metal.

Figure 6:
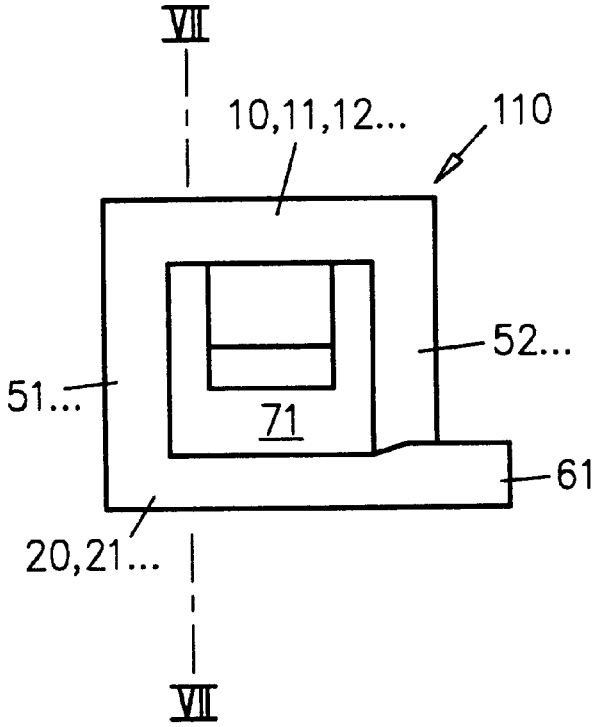
FIG. 6 is a plan view of a further refinement of the coil.
Figure 7:
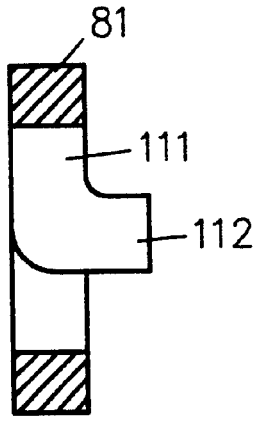
FIG. 7 is a sectional view taken along the section line VII—VII shown in FIG. 6.

Let us now refer to FIGS. 6 and 7.

A coil 110 shown in FIG. 6 is constructed and produced in the same way as the coil shown in FIG. 1; this can be seen from the reference numbers 10, 11, 12 . . . . , 20, 21 . . . . , 51 . . . 61 . . .

If one considers the coil shown in FIG. 5, then a web 111 would be integrally formed on the web which is represented by the reference number 81 in FIG. 5 and also has the reference number 81 in FIG. 7, which web 111 projects into the area 71 inside the coil and is fitted at the inner end, approximately on the center line M—M (see FIG. 5), with a limb 112, which projects parallel to the center line, and on the center line, into the inside of the coil 110. The limb 112 is used as a core for the coil configuration shown in FIG. 5, in conjunction with FIGS. 6 and 7.

It should also be mentioned that the dimensions of the configurations shown in drawings are not to scale.

We claim:

1. A magnetic release for an electrical switching device, comprising:

a coil being stamped and bent from sheet metal composed of a material being electrically highly conductive and magnetically highly permeable, said coil having first webs disposed at a given distance from one another in a first plane and second webs disposed at the given distance from one another in a second plane and in each case run parallel to one another and offset with respect to one another, said coil having connecting webs in each case disposed between one end of one of said first webs and an adjacent end of one of said second webs and in each case one end of one of said second webs and an adjacent end of one of said first webs, said first webs, said second webs and said connecting webs disposed in such a manner that said first webs, said second webs and said connecting webs are in a helical shape around a center axis, said first webs, said second webs and said connecting webs defining an inside region in a form of a through-opening, said coil additionally having a stationary contact piece of a contact point for a circuit breaker;

a holder for a thermal release integrally formed on said coil;

a core accommodated in said through opening of said coil; and an armature selected from the group consisting of plunger-type armatures moving inside said coil and hinged armatures.

2. The magnetic release according to claim 1, including:

an arc guide rail integrally formed on said coil, adjacent to said stationary contact piece; and an arc splitter stack, for arc quenching, integrally formed on said arc guide rail, inside the electrical switching device.

3. The magnetic release according to claim 1, including an L-shaped lug integrally formed at one end on said coil, said L-shaped lug having a free limb projecting into a coil area on its center axis, and forms said core.

4. The magnetic release according to claim 1, wherein said first and second webs are U-shaped webs having limbs, and said U-shaped webs are open towards an opposite plane.

5. The magnetic release according to claim 4, wherein each of said connecting webs are alternately connected at one end to one of said limbs of one of said U-shaped webs, and at another end to one of said limbs of another one of said U-shaped webs.

6. The magnetic release according to claim 5, wherein said connecting webs each assume an angle to one another, and one of said connecting webs runs parallel to another, over others of said connecting webs.

7. The magnetic release according to claim 1, wherein said connecting webs run parallel to one another at right angles to said center axis.

8. A circuit breaker, comprising:

a magnetic release including:

a coil being stamped and bent from sheet metal composed of a material being electrically highly conductive and magnetically highly permeable, said coil having first webs disposed at a given distance from one another in a first plane and second webs disposed at the given distance from one another in a second plane and in each case run parallel to one another and offset with respect to one another, said coil having connecting webs in each case disposed between one end of one of said first webs and an adjacent end of one of said second webs and in each case one end of one of said second webs and an adjacent end of one of said first webs, said first webs, said second webs and said connecting webs disposed in such a manner that said first webs, said second webs and said connecting webs are in a helical shape around a center axis, said first webs, said second webs and said connecting webs defining an inside region in a form of a through-opening, said coil additionally having a stationary contact piece of a contact point for a circuit breaker;

a holder for a thermal release integrally formed on said coil;

a core accommodated in said through-opening of said coil;

an armature selected from the group consisting of plunger-type armatures moving inside said coil and hinged armatures; and a housing having inner surfaces, mutually opposite ones of said inner surfaces having strips which engage between coil turns in order to guide said coil.

9. The circuit breaker according to claim 8, wherein said strips are configured such that they are used to guide at least one of said core and said armature.

10. The circuit breaker according to claim 8, including an arc guide rail integrally formed on said coil, said core, said stationary contact piece and said arc guide rail are disposed at one end of said coil, and said holder for the thermal release is disposed at another end of said coil.

* * * * *